US005322119A

United States Patent [19]

Kadwell et al.

[11] Patent Number: 5,322,119

[45] Date of Patent: Jun. 21, 1994

[54] SUBMERSIBLE WELL PROBE SLEEVE

[76] Inventors: Robert J. Kadwell, 1111 Sheridan Ave. North, Minneapolis, Minn. 55411; Michael A. Yusella, 30 Wexford Ct., Phillipsburg, N.J. 08865; Robert J. Clark, P.O. Box 12, Buttzille, N.J. 07829

[21] Appl. No.: 944,451

[22] Filed: Sep. 14, 1992

[51] Int. Cl.[5] ..... E21B 33/068; F04B 49/06

[52] U.S. Cl. ..... 166/67; 166/69; 166/107; 417/36

[58] Field of Search ..... 166/255, 380; 417/4, 417/6, 7, 36, 40; 137/2

[56] References Cited

U.S. PATENT DOCUMENTS

| | | | |
|---|---|---|---|
| 4,392,529 | 7/1983 | Burwell | 166/255 |
| 4,392,782 | 7/1983 | Kuehn, III et al. | 417/36 |
| 4,466,777 | 8/1984 | Kimberlin | 417/36 |
| 4,481,781 | 11/1984 | Tsukamoto | 417/36 |
| 4,739,786 | 4/1988 | Parkinson | 137/2 |
| 5,035,581 | 7/1991 | McGuire et al. | 417/36 |

OTHER PUBLICATIONS

"The Technology of Artificial Lift Method", pp. 46–53, by Brown et al. (Petrler Publishing Co., 1980).

*Primary Examiner*—Ramon S. Britts
*Assistant Examiner*—Frank S. Tsay
*Attorney, Agent, or Firm*—Leone & Moffa

[57] ABSTRACT

A submersible well probe sleeve made of a cylindrical tube attached to a submersible pump. The cylindrical tube has a number of slots exposing access to a protective pouch. Inside the protective pouch a fluid level sensing probe is placed. The fluid has access to the pouch through slots in the sleeve. Opposite the pouch at a predetermined level is a number of fluid inlet holes which provide access to the center of the cylinder by fluid in the well. The submersible pump draws fluid into the center of the cylinder past the probe. The submersible well probe sleeve provides a fixed relative position between the probe and the inlets such that the level of the well can be maintained at a precise level and the probe can be installed in the well while under the protection of the sleeve.

20 Claims, 2 Drawing Sheets

10

16
2
2
16
22
18
12
20
26
27
3
3

26
12
24
30
27
22

26
12
27

10

14
14
12
26
27

SUBMERSIBLE WELL PROBE SLEEVE

The invention relates to a method of protecting and positioning a submersible well probe and more particularly for providing a sleeve into which a submersible well probe is inserted along with a submersible pump.

BACKGROUND OF THE INVENTION

Submersible pumps are installed at or near the bottom of a well. The operation of the submersible pump depends on the existence of a column of pumpable fluid above the submersible pump in the well. The submersible pump is self-priming if there is fluid above the pump. In systems that incorporate submersible pumps a fluid level probe is sometimes incorporated. This probe is used to send a sensing signal to a control unit that turns the submersible pump on and off to maintain the fluid at a certain level. The submersible pump can be used to pump off an excess residue above the probe or as used in an alternative configuration could maintain the level of the well at the probe height.

Frequently probes are installed along with the submersible pump. Such probes sometimes are subject to harsh environmental conditions and, therefore, are subject to damage which may result in failure. The position of the probe is critical in the operation of a submersible well pumping system. The pump probe sometimes is installed after the submersible pump is placed in the well mounted in its own carrier. Occasionally the probe is damaged during insertion into the well. During installation it may be hard to locate the probe precisely in relation to the pump.

It is therefore a motive of the invention to provide a submersible pump probe protection sleeve that allows precise alignment of the probe with respect to the submersible pump and provides for the effective protection of the probe while being installed.

SUMMARY OF THE INVENTION

The invention provides a submersible well probe sleeve for use with a submersible pump. A pump sleeve with an open top and bottom is fitted with an internal mounting for attaching the sleeve to a submersible pump. The pump draws fluid from the interior of the sleeve. The material to be pumped enters the pump sleeve from the top and from a plurality of holes in the top portion radially distributed around the sleeve. Opposite the plurality of holes is a series of slots which are used to allow fluid to enter a probe containment area. The fluid level probe is placed within the containment area such that the fluid can come into intimate contact with the probe. The probe is prevented from moving in relation to the containment area by a number of containment slots. The probe is maintained in a fixed position relative to the submersible pump such that a control unit can reliably detect the fluid level. The fluid level is maintained by the pumping action of the submersible pump within the pump sleeve. The probe is also protected from being damaged during installation and operation by the fact that the containment area is within a depression formed in the retaining sleeve. The depression is large enough to hold the probe but not so large as to interfere with the flow of fluids to the submersible pump.

Other objects, features and advantages of the present invention will become apparent to those skilled in the art through the description of the preferred embodiment, claims and drawings herein where like numerals refer to like elements.

DETAILED DESCRIPTION OF THE PREFERRED EMBODIMENT

Figure 1:
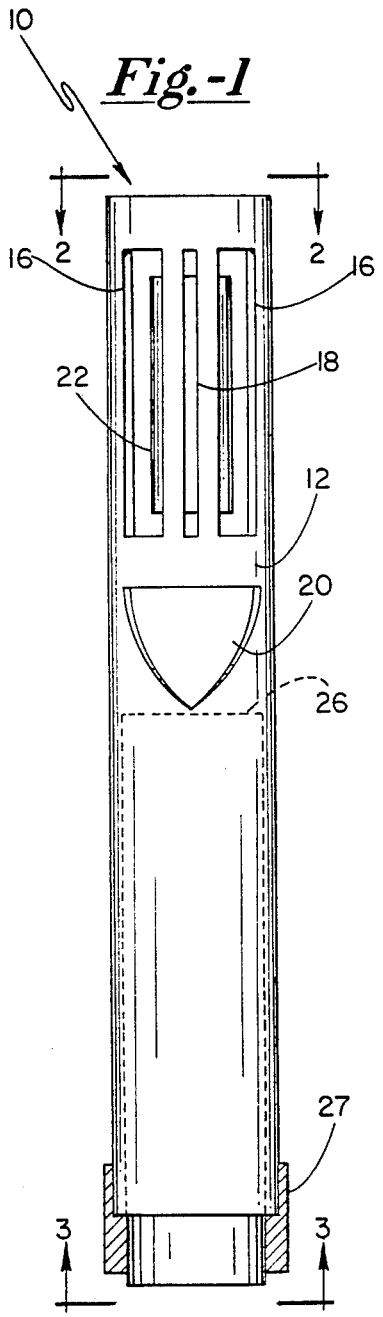
FIG. 1 shows a drawing of the front view of the submersible well probe sleeve.

Now referring to FIG. 1 which shows a front view of the submersible well probe sleeve apparatus of the invention. The submersible well probe sleeve 10 is comprised of a number of elements. The submersible sleeve 12 is attached to a submersible pump 26. Submersible pump 26 is located at the bottom of the sleeve 12. Submersible pump 26 may be any suitable commercially available submersible pump. Typically, submersible pump 26 will protrude below the submersible sleeve 12. A seal 27 seals the bottom end of the pump to prevent water from seeping up through the bottom of the sleeve. The seal 27 may advantageously comprise a rubber gasket secured by well known means, such as a clamp. The seal 27 operates so as to maintain the pump as a point source intake.

Sleeve 12 has a number of openings that can be seen on the front view. The first opening is advantageously a heal-shaped opening 20 which permits fluids to flow to the rest of the openings. The containment area 24 is shown having access by slots 16 and 18. The containment area 24 comprises fluid level probe 22 which is placed between the remaining portions of the sleeve that are left after the slots 16 and 18 are made in the outside of the sleeve 12. The top portion of the sleeve 12 is open to permit fluid to flow into the area after which it can be pumped by the submersible pump 26. The probe 22 typically comprises an actuator, such as a float switch, wherein the actuator is placed.

Figure 2:
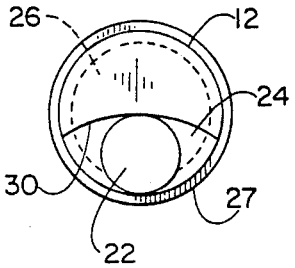
FIG. 2 shows a top view of the submersible well probe sleeve.

Now referring to FIG. 2 which shows a top view of the submersible well probe sleeve 10. The top view shows the opening in the top of the sleeve 12 along with submersible pump 26 and the probe 22 installed between the back retaining wall 30 and the front of the sleeve 12. The probe is held in place by the restoring force provided by the outside wall of the sleeve 12 and the retaining wall 30.

Figure 3:
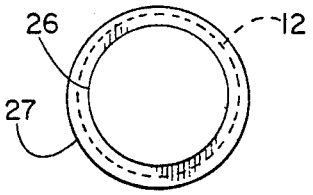
FIG. 3 shows a bottom view of the submersible well probe sleeve.

Now referring to FIG. 3 which shows the bottom view of the submersible pump 26 and the submersible well probe sleeve 12. It can be seen from FIG. 3 that the submersible pump is positioned in the bottom of the probe sleeve 12 which enables it to draw fluids down a remaining upper portion of the sleeve 12.

Figure 4:
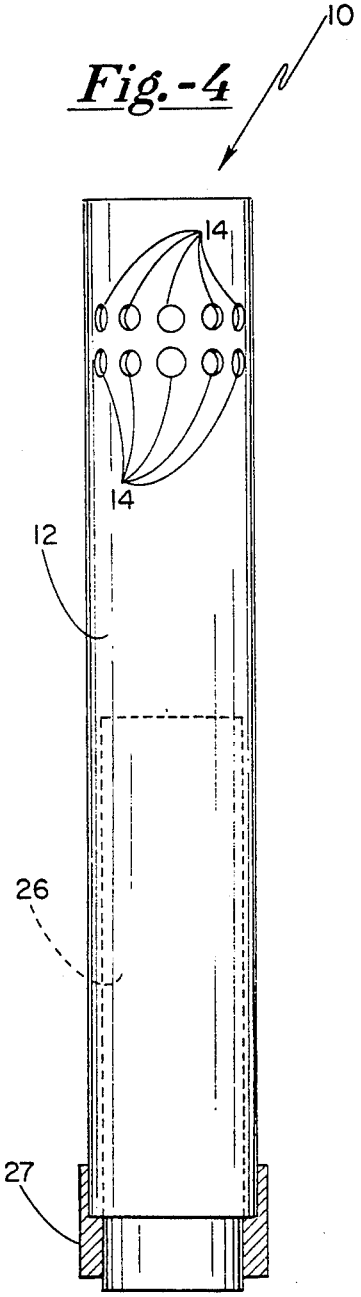
FIG. 4 shows a back view of the submersible well probe sleeve.

Now referring to FIG. 4 which shows a back view of the submersible well probe sleeve with optional inlets 14. The inlets 14 provide a mechanism, known as an overflow intake, by which fluid can enter the top of the sleeve 12 and the submersible pump 26. Probe 22 includes at least one actuator which is in the same horizontal plane as the overflow intake.

Figure 5:
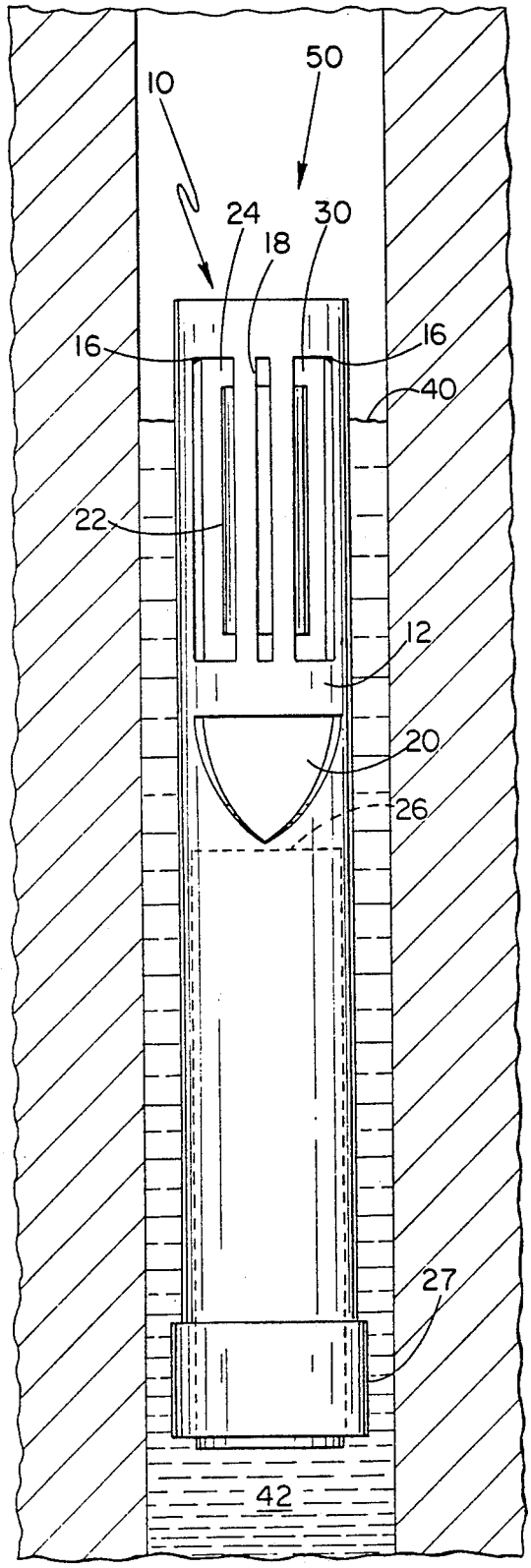
FIG. 5 shows a drawing of the front view of the submersible well probe sleeve installed in a well.
Figure 6:
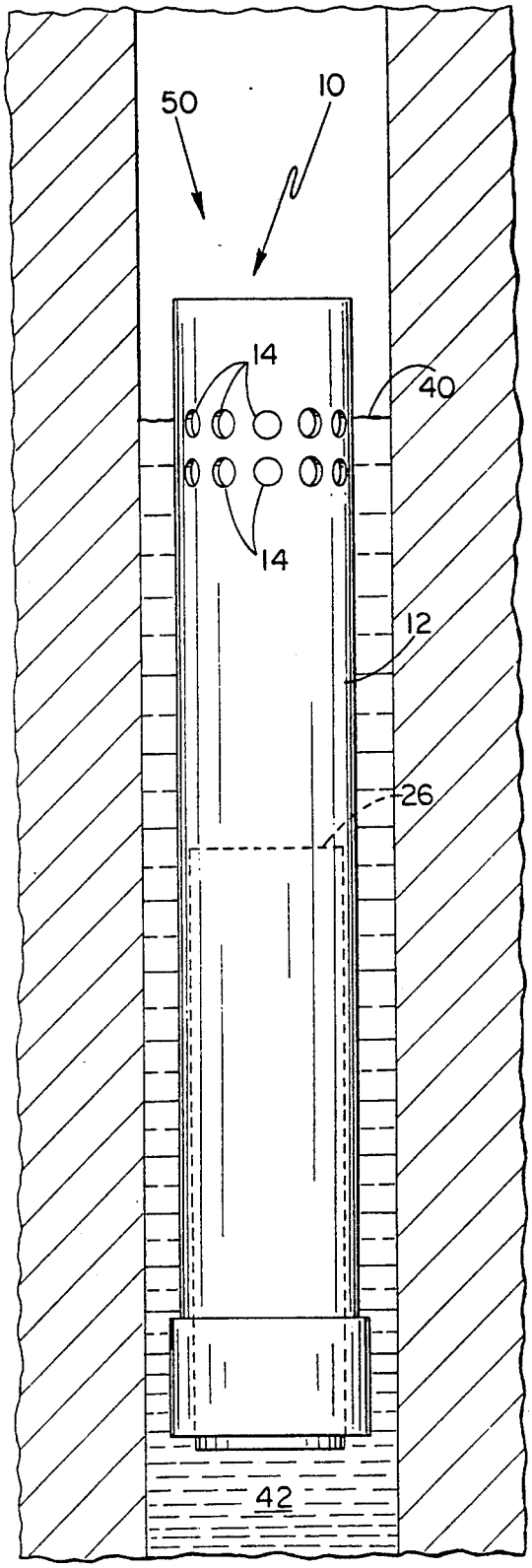
FIG. 6 shows a back view of the submersible well probe sleeve installed in a well.

Now referring to FIG. 5 which shows the submersible well probe sleeve 10 installed in a well 50. The well 50 is filled with the fluid 42 up to level 40. The submersible pump 26 is maintaining the level of the well 50 at level 40 by drawing down fluid 42 through the inlets 14 shown in FIG. 6. The level of the probe 22 is fixed precisely with respect to the inlets 14 by the sleeve 12 One advantage of the apparatus of the invention is that the submersible system is able to maintain a predetermined level with respect to the inlets 14.

Those skilled in the art will recognize that various different openings can be used to provide the probe 22 with access to the fluid 42. The inlets 14 could also be of various shapes as, for example, slots, squares or one continuous opening. The inlets provide easy passage of the fluid into the area of the submersible pump. It can be easily seen by those skilled in the art that the sleeve also provides protection from the environmental conditions of the well 50 due to the recessed nature of the protective pouch formed by the back plate 30 and the sleeve 12. The sleeve 12 may comprise any material compatible with the material being pump. One useful sleeve material is aluminum. Plastic may be useful for some applications.

The invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself.

What is claimed is:

1. A submersible well probe sleeve for submersion in a well wherein the well contains a fluid, the submersible well probe sleeve comprising:

(a) a protective member located in the well having a bottom and a top portion and an opening in the top portion for fluid to enter an interior chamber of the protective member, wherein a submersible pump is attached to the protective member; and (b) probe retaining means to hold a submersible well probe within the interior chamber of the protective member such that the fluid may come into intimate contact with the submersible well probe.

2. The submersible well probe sleeve of claim 1 wherein the probe retaining means is recessed into one side of the protective member.

3. The submersible well probe sleeve of claim 1 wherein the probe retaining means further comprises at least one fluid access port for fluid to enter the area of the probe retaining means.

4. The submersible well probe sleeve of claim 3 wherein the fluid access ports comprise holes cut in the probe retaining means.

5. The submersible well probe sleeve of claim 1 wherein the probe retaining means further comprises a pocket attached to the protective member.

6. The submersible well probe sleeve of claim 1 further including a submersible fluid pumping means attached to the protective member so as to pump the fluid.

7. The submersible well probe sleeve of claim 6 wherein the submersible fluid pumping means is attached to the bottom of the protective member.

8. The submersible well probe sleeve apparatus of claim 1 wherein the submersible well probe sleeve further includes a submersible pump located in the bottom of the submersible well probe sleeve to pump fluid from within the submersible well probe sleeve wherein the submersible well probe is held at a level suitable for sensing fluid intake.

9. The submersible well probe sleeve apparatus of claim 1 wherein the protective member is comprised of material compatible with material being pumped.

10. The submersible well probe sleeve apparatus of claim 1 wherein the access to the interior is by inlets drilled in the protective member.

11. The submersible well probe sleeve of claim 1 wherein the protective member is substantially cylindrical with a smooth surface to fit in the well.

12. A submersible sleeve comprising a cylindrical member having an open top and a recessed retaining pouch attached to the cylindrical member for retaining a probe, wherein a pump is attached to the cylindrical member, and wherein the submersible sleeve protects the probe and the pump.

13. The submersible well probe sleeve of claim 12 wherein the cylindrical member also has retaining pouch inlet holes.

14. The submersible well probe sleeve of claim 12 further including a probe inserted in the recessed retaining pouch.

15. The submersible well probe sleeve of claim 12 wherein a submersible pump is included in the bottom of the cylindrical member.

16. The submersible well probe sleeve of claim 15 wherein a seal is affixed so as to seal any opening between the cylindrical member bottom and the submersible pump.

17. The submersible well probe sleeve apparatus of claim 12 wherein the cylindrical member is comprised of a material compatible with fluids in the well.

18. The submersible well probe sleeve of claim 12 wherein the recessed retaining pouch comprises a back plate attached to the cylindrical member.

19. A method of inserting a submersible pump and probe into a well comprising the steps of: (a) securing a submersible well probe sleeve to the submersible pump;

(b) installing a submersible probe into a protective pocket in the submersible well probe sleeve;

(c) installing the submersible well probe sleeve and submersible pump in a well to a predetermined depth in the well.

20. A submersible sleeve comprising an elongated sleeve member having an open top and a recessed retaining pouch attached to the elongated sleeve member for retaining a probe, wherein a pump is attached to the cylindrical member, and wherein the submersible sleeve protects the probe and the pump.

* * * * *